United States Patent [19]

Howard et al.

[11] 4,096,675

[45] Jun. 27, 1978

[54] SPLIT-SLAB HOUSE CONSTRUCTION

[75] Inventors: John R. Howard, Houston; Robert W. Loomis, Freeport, both of Tex.

[73] Assignee: Next Generation Housing Corporation of America, Houston, Tex.

[21] Appl. No.: 717,747

[22] Filed: Aug. 25, 1976

[51] Int. Cl.[2] ..... E04B 1/343

[52] U.S. Cl. ..... 52/79.1; 52/143; 52/745

[58] Field of Search ..... 52/73, 79, 143, 745, 52/93, 122, 126, 2, 79.1; 214/1; 114/67; 180/116, 7, 121, 127

[56] References Cited

U.S. PATENT DOCUMENTS

| | | | |
|---|---|---|---|
| 2,749,592 | 6/1956 | Vartia | 52/745 |
| 3,520,092 | 7/1970 | Petrik | 52/143 |
| 3,520,381 | 7/1970 | Pinder | 180/127 |
| 3,693,729 | 9/1972 | Blurton et al. | 180/127 |
| 3,708,931 | 1/1973 | Button | 52/143 |
| 3,778,953 | 12/1973 | Delorean | 52/745 |
| 3,811,722 | 5/1974 | Jones | 52/73 |
| 3,861,093 | 1/1975 | Robinson | 52/79 |

OTHER PUBLICATIONS

"Stirling Homex Corporation", Annual Report 1970, pp. 7, 9, 10, 11 and cover relied upon.

*Primary Examiner*—J. Karl Bell

*Attorney, Agent, or Firm*—Russell D. Weaver; Murray Robinson

[57] ABSTRACT

A house includes a split-slab foundation having an upper portion constructed within an enclosed on-tract factory and a lower portion constructed on the lot. The superstructure of the house is erected upon the upper portion, and the super-structure and upper portion are transported off-highway by air-cushion transport to the lot where the slab upper portion is mated with the lower portion. The upper portion is uniquely constructed with areas of increased thickness to withstand the shear forces of parts of the house having substantial weight, with pipe passageways to accommodate pipes built into the lower portion, and with means for releaseably attaching an air impermeable skirt used for air cushion transport. The lower portion is uniquely constructed with recessed areas to accommodate the areas of the upper portion having increased thickness and the pipes therein are positioned to be in register with the passageways in the upper portion. Both the upper and lower portions are provided with means for securing the upper portion to the lower portion.

34 Claims, 15 Drawing Figures

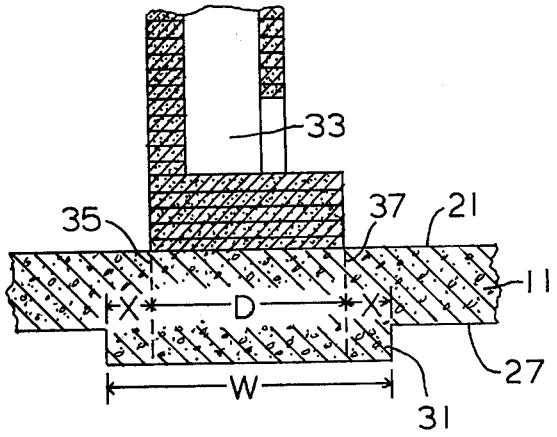
FIG. 8
FIG. 9
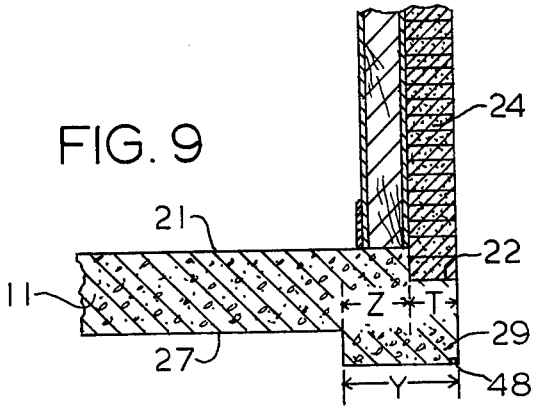
FIG. 10
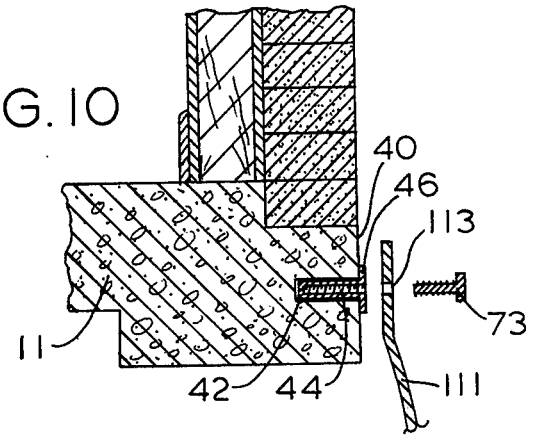

SPLIT-SLAB HOUSE CONSTRUCTION

FIELD OF THE INVENTION

The present invention relates generally to a form of house construction and more particularly to a procedure for single-builder development of a large tract of land by mass producing houses of such construction at a plant, preferably within an enclosed factory and then transporting the completed houses by air cushion to their ultimate site.

DESCRIPTION OF THE PRIOR ART

In an effort to reduce the ever-increasing cost of building houses, members of the home construction industry often turn to factory-built homes. For present purposes, a home may be considered to be any form of dwelling of some degree of permanence such as mobile homes, quonset huts, and including also more conventional structures known as houses. Factory building of homes using production line procedures within the confines of a partially or fully-enclosed structure offers numerous cost-reducing advantages over traditional on-site construction. Losses due to weather-created delays and damages, vandalism, and theft are substantially reduced if not eliminated altogether. Equipment and labor can be concentrated in a small area resulting in more efficient allocation of such equipment and manpower. Production line techniques allow for simpler, more straight-forward methods of construction as well as for delegation of specialized duties for laborers.

In addition to such expense-saving features, the quality of factory-constructed homes is better assured. For instance, the homes still in process of construction are not exposed to inclement weather conditions resulting in accelerated decay and warping of wooden frame. Also, production line techniques assure better supervision of construction workers and improved quality control.

Examples of techniques of constructing factory-built homes are shown by U.S. Pat. No. 3,571,993, issued to Potter on Mar. 23, 1971; U.S. Pat. No. 3,796,162, issued to Burdick, et al, on June 28, 1972; and U.S. Pat. No. 3,757,931, issued to Baker et al., on June 9, 1971. The *Burdick and Baker* references disclose a method of moving mobile homes through an assembly line by way of a form of air bearing transport. Potter discloses an assembly line prefabricated building structure and means for moving such a structure to its ultimate site by way of a crane. Potter further discloses advance preparation of the ultimate site by pouring a set of four or more concrete piers to which the prefabricated structure is attached. Another form of factory constructed home taught by the prior art is the mobile home. After being pulled to a lot, a mobile home is generally attached to the lot by such means as guy-wires or hurricane straps. In many instances, a concrete block foundation is constructed beneath the mobile home and the wheels then are removed.

Acceptance of such factory-built homes has been far from unanimous for three reasons. First, such homes are often regarded as unsafe because of their light construction and because they are poorly secured to the lot itself. High winds often cause severe damage to mobile homes and similar modular homes while homes of conventional construction are unscathed. Second, lightweight construction, steel beams and trusses detract from both the interior and exterior appearance of the home. Most of the factory-built homes in the prior art have a box-like appearance with a simplified floor plan that does not appeal to most home purchasers. Third, factory-built homes do not offer many of the desired features of the conventional house including slab foundation, picture windows, sliding glass doors, brick exteriors, fireplaces, high-trussed roofs, staircases, porches, attached garages, two-story floor plans and basements.

The foregoing deficiencies arise in large part because many of the prior art factory built homes are intended to be transported over public highways or on railroads, which imposes design limitations relating to weight and shape.

These problems might be limitedly corrected by on-site finishing of the home. Such finishing reintroduces the problems of conventional construction that factory construction seeks to eliminate thus defeating the advantages of factory-built homes.

Potter, supra, seeks to solve these problems by means of a special house structure. The actual structure described in Potter is substantially different from that used in conventional construction thus resulting in a home that is different from conventional houses both in appearance and in features. Furthermore, a stated purpose of Potter is a house having a minimum weight. Such a limitation automatically eliminates such heavy structural items as fireplaces, attached garages and brick exteriors.

Thus, the problem remains of providing a factory-built home that offers the safety, appearance and features of the conventional house. A technique is required that will allow for transport from factory to site of a completed home having any construction, including brittle features such as slab, picture window, high-truss roof, sheetrock walls, brick exteriors, fireplaces, staircases and the like, e.g. a conventional house.

SUMMARY OF THE INVENTION

The present invention is a house having a split-slab foundation, and a method of building and transporting such a house whereby it is susceptible to mass production in an on-tract enclosed factory structure resulting in rapid, economical development of a large tract of land. The split-slab has an upper portion upon which a house of any composition and design is built. The upper portion is of substantially uniform thickness, but may be reinforced by areas of increased thickness at points where the weight of the house structure at those points is substantial, such as points upon which a brick wall or fireplace is constructed. The lower portion is prepared on a home site and has an upper surface designed to mate with the lower surface of the upper portion. Thus, recesses in the upper surface of the lower portion are provided where the upper portion is reinforced by areas of increased thickness. The lower portion is appropriately designed to the soil conditions in the area and may include beams and bell-bottom piers. The lower portion and upper portion may be correlatively designed to accomodate utility connections, especially drainage pipes installed through or within the foundation.

The method involves selecting a multi-lot tract of land, building on the tract a factory wherein a plurality of house structures are built to be placed on the lots, and building an on-tract enclosed factory, constructing the major portion of each house within the enclosed factory by pouring the upper portion of the foundation, allowing it to cure, and by means of a production line, constructing the complete house superstructure on the upper portion while it remains indoors. When construction of the house is completed, the house is towed to the home-site by air-cushion transport which is defined herein as attaching a flexible, air impermeable skirt to the periphery of the upper portion and forcing air beneath the upper portion by a blower such that the air is trapped within the confines of the skirt and beneath the slab. The upper portion of the house, together with the house super-structure constructed thereon, is thus lifted upon an air-cushion allowing it to be pulled along the ground by tractor or other means. Although the house may be extremely brittle, the house may be towed over the tract which may be rough, unprepared terrain or new streets not yet in general use. At the home-site, the air-cushion supported house is placed over a prepared lower portion adapted to receive the upper portion and the house is lowered until the upper portion meshes with and rests upon the lower portion.

By virtue of the present invention, a home of any construction, especially of conventional house construction, may be factory-assembled and installed on a house-site. The only on-site construction involved is preparation of a portion of the foundation and connection of utilities, such as gas, water, power and sewage. Also, factory construction of upper portion of the foundation and the house superstructure need not vary from one geographical region to another. Only construction of the lower portion of the foundation must be varied according to soil conditions.

The method of the invention can be used to develop a large tract of land by subdividing the tract, erecting the enclosed plant, constructing the upper portion of the foundations and house superstructures within the plant, transporting them to and mating them with their respective lots, disassembling the plant and moving the equipment to a second tract of land to be developed.

Air-transport of large, heavy objects across rough terrain is not claimed generally as the invention. Such apparatus and methods are described in the prior art by such publications as U.S. Pat. No. 3,693,729 issued to Blurton, et al., on Sept. 26, 1972 (transport of oil well drilling rig); U.S. Pat. No. 3,840,089 issued to Allison on Oct. 8, 1974 (modular air-cushion platform); U.S. Pat. No. 3,520,381 issued to Pinder on July 14, 1970 (transport of storage tank); and U.S. Pat. No. Re. 28,101 issued to Knorr on Aug. 6, 1974 (transport of oil well drilling rig). These references, however, do not disclose use of the air-cushion technique with a structure having an irregular shape which may result in internal corners nor do they disclose that such a technique will work for brittle objects. Furthermore, the air-cushion transport disclosed by these references does not teach mating an upper portion of a foundation with a lower portion of the foundation or running utility connections, including plumbing, through the floated object, nor the development of a tract by building a factory thereon and air transporting a house structure off-highway to a lot on the tract.

Nor is air transport of houses broadly claimed as invention. U.S. Pat. No. 3,796,162 issued to Burdick, et al, on June 28, 1972, and U.S. Pat. No. 3,757,931 issued to Baker, et al., on June 9, 1971 teach use of air bearings in transporting houses along assembly lines. The air-bearing methods disclosed in Burdick and Baker, however, as distinguished from air-cushion transport, are not suited for transporting a house from the factory to the mating site for several reasons. First, the air-bearing methods require a smooth, level path of transport thus negating use on rough terrain. Second, the height to which th object can be elevated above the ground is very small. Thus, the object cannot be guided over utility connections installed in the mating site. Third, because the "lift" of the air bearing occurs over a small surface area, the air pressure required to lift an entire conventionally built house is very high and, essentially, prohibitive. Fourth, the air bearing methods use a platform on which the house rests thus requiring the additional steps of either removing the platform or removing the house from the platform prior to mating with the site. Finally, Burdick and Baker involve the use of rails which are not feasible for transporting a house from factory to ultimate site. Comparatively, air-cushion transport may be used over rough terrain, on inclines and declines, may be used to lift a house to heights of several feet, requires air-pressure in the order of only two pounds per square inch, and requires no rails.

BRIEF DESCRIPTION OF THE DRAWINGS:

For a detailed description of a preferred embodiment of the invention, reference will be made to the accompanying drawings wherein:

FIG. 8 is a sectional detail of the upper portion of the foundation of said preferred embodiment;

FIG. 9 is a sectional detail of the upper portion of the foundation of said preferred embodiment;

FIG. 10 is a sectional detail of a preferred method of attaching the skirt to the upper portion;

DESCRIPTION OF THE PREFERRED EMBODIMENT

Figure 1:
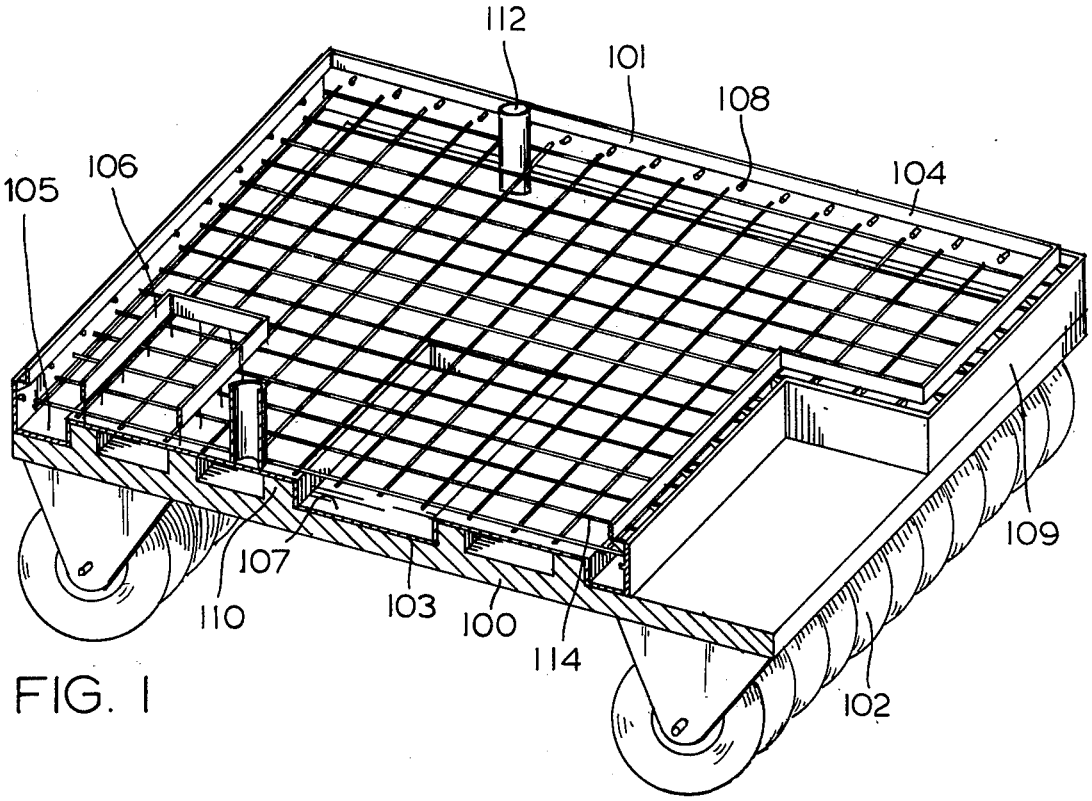
FIG. 1 is a section taken of a pictorial view of the mold used to form the upper portion of the foundation of a preferred embodiment of the invention placed on top of a portable frame.

The method of building houses taught by the present invention and illustrated in FIGS. 1 through 10, and 15 of the drawings includes building an enclosed factory on a tract of land to be developed, surveying the tract to divide it up into housesites, preparing the housesites, and the steps performed within the enclosed factory of pouring the upper portion 11 of a concrete slab foundation 13 and erecting a house superstructure 15 upon the upper portion, and outside the enclosed factory preparing a mating site which includes the lower portion 17 of the foundation 13, transporting the upper portion 11 with house superstructure 15 thereon from the enclosed factory to the mating site by means of air-cushion transport, and mating the upper portion 11 to the lower portion 17.

In performing the method of the invention in the preferred manner, the enclosed factory or plant is erected upon a tract of land to be developed as medium density residential property. The plant should be large enough to house several houses at a single time as well as house supplies and equipment used to construct such houses. The plant should have doors large enough to allow a completed house of substantial size to move through them. The nature and design of the plant or factory itself should be such that it can be quickly disassembled and later re-erected central to a second tract of land to be developed.

After the plant is erected, construction of the upper portion and lower portion of the foundation is commenced simultaneously within the enclosed structure and at the mating site, respectively. Upper portion 11 is formed within mold 101. As shown in FIG. 1, mold 101, having base 103, side walls 109, offsets 104 and 106 and a plurality of hole molds 108 attached to side walls 109, is placed on mobile frame 100 which has supports 110 and wheels 102. Frame 100 is large enough to support all of mold 101 with no overhang. Both mold 101 and frame 100 are constructed of rigid metal such as steel.

Figure 2:
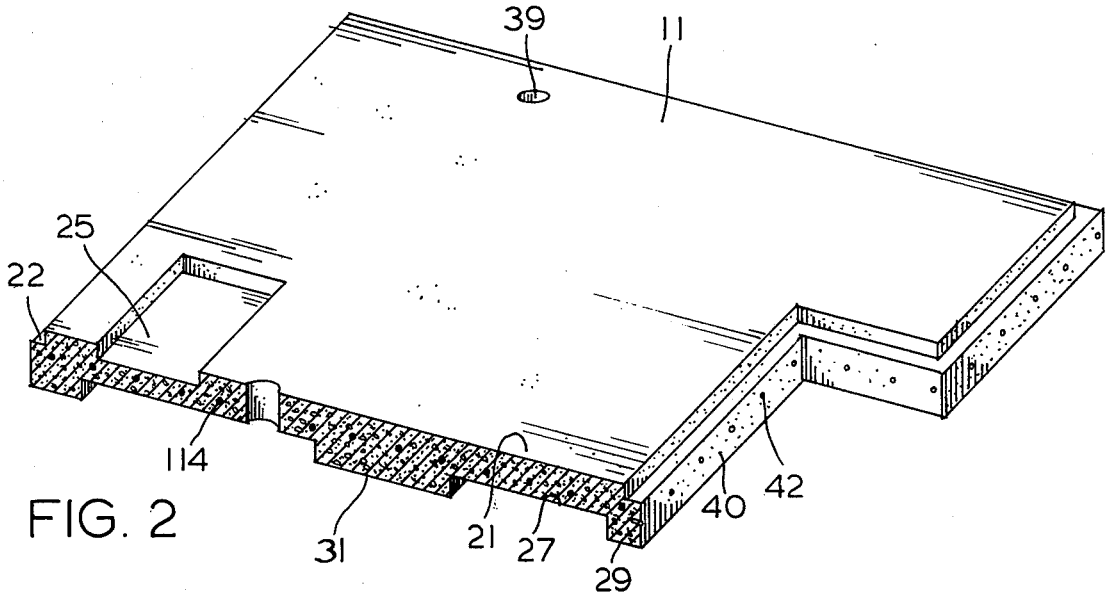
FIG. 2 is a section taken of a pictorial view of the upper portion of the foundation of said preferred embodiment of the invention prior to construction of a house super-structure thereon.
Figure 3:
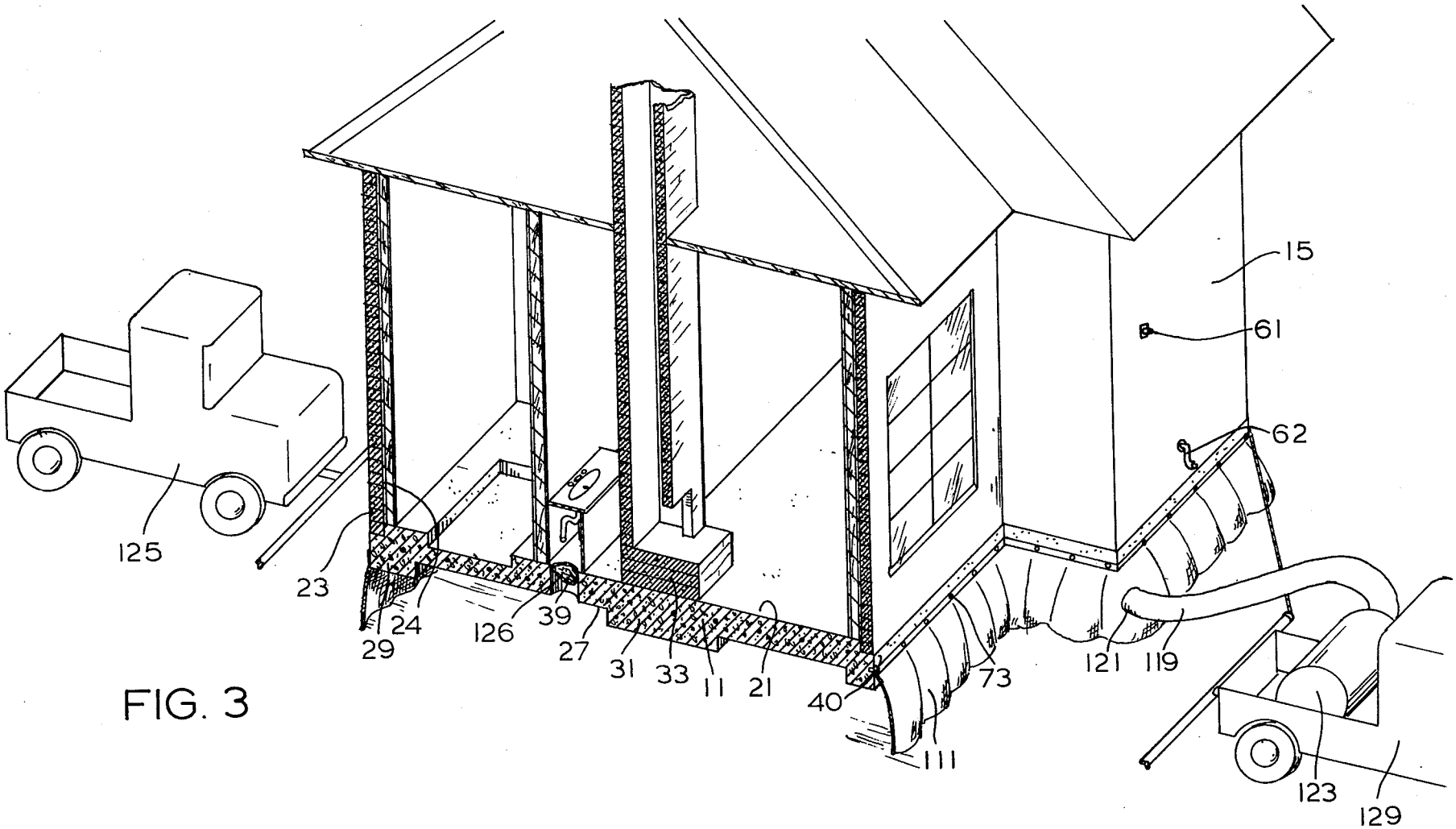
FIG. 3 is a section taken of a pictorial view of the upper portion of the foundation of said preferred embodiment with the house superstructure constructed thereon lifted upon an air cushion.

The upper portion of the foundation, as formed in its corresponding mold, has a configuration that varies according to the floor plan and general nature of the house superstructure to be constructed thereon. Basically, upper portion 11, as shown in FIG. 2, and as formed by mold 101 of FIG. 1, is a steel-reinforced concrete slab having generally flat upper surface 21. If house superstructure 15 is to have a brick, brick veneer, adobe block, or similar exterior surface, upper surface 21 of upper portion 11 has perimeter recess 22 extending about its perimeter to accomodate the bricks or blocks 23 of exterior wall 24 as shown in FIG. 3. Upper surface 21 may additionally have interior recesses 25, as seen in FIG. 2, to allow for "sunken" rooms. Recesses 22 and 25 are formed as necessary using techniques known in the art, such as by using offsets 104 and 106.

Lower surface 27 of upper portion 11, as shown in FIG. 2 and as formed in the mold of FIG. 1, is generally flat and is parallel to upper surface 21, but has ridges 29 and 31 where reinforcement of the upper portion is required because objects of substantial weight, such as brick or block wall 24 and fireplace 33, as shown in FIG. 3, will be constructed on upper portion 11. Ridges 29 and 31 are located directly beneath the corresponding objects of substantial weight and extend beyond the area of contact between the objects and upper surface 21. Thus, as shown in detail in FIG. 8, ridge 31 corresponding to fireplace 33 is located directly beneath fireplace 33 as seen by dotted lines 35 and 37 and has a width W which extends beyond depth D of fireplace 33 by a distance X in either direction. By extending beyond the area of contact by a distance X, ridge 31 reinforces not only against increased weight of fireplace 33, but also against the shear force created along lines 35 and 37 by the difference in downward force on either side of each of lines 35 and 37. Similarly, as shown in detail in FIG. 9, ridge 29 has a width Y that extends beyond thickness T of wall 24 by a distance Z. Base 103 of mold 101 has recessed areas 105 and 107 which result in formation of ridges 29 and 31.

As seen in FIG. 2, upper portion 11 further has a plurality of drainage pipe passageways 39 extending therethrough. Each drainage pipe passageway 39 is perpendicular to the plane of upper surface 21. Passageways 39 are designed to accomodate the drainage pipes which will connect to the plumbing fixtures in house superstructure 15. Passageways 39 are generally cylindrical and have a cross-sectional area corresponding closely to the cross-sectional area of the pipe to be accomodated. Location of passageways 39 will vary according to the floor plan of house 15 and the location of the plumbing fixtures therein. Passageways 39 are constructed by inserting passageway molds 112 into mold 101 as seen in FIG. 1.

Perimeter edge 40 of upper portion 11, as shown in FIG. 2 and as formed in mold 101 of FIG. 1, has a plurality of skirt attachment holes 42 formed therein by hole molds 108 attached to side walls 109 of mold 101. Skirt attachment holes 42 are cylindrical in shape and have axes perpendicular to the corresponding perimeter edge 40. As shown in detail in FIG. 5, perimeter edge 40 also has upper edge recess 48 at the junction of lower surface 27 and perimeter edge 40.

When mold 101 is properly constructed to form desired configuration of upper portion 11, steel reinforcing rods 114 are positioned within mold 101 and concrete is poured. When concrete of upper portion 11 has cured sufficiently within mold 101, side walls 109 of mold 101 are removed. Utility passageway molds 112 are removed leaving utility passageways 39. House superstructure 15 is then erected upon upper portion 11.

Construction of the house superstructure may include erection of any kind of wall, including gypsum board, wood panel, ceramic material, and brick, separating the rooms. The ceiling may be of any construction, including gypsum board and tile. The roof may have a high peak or it may be flat; numerous gables can be included. The roof may be covered with any surface covering. Sliding glass doors, Florida rooms, screened porches, attached garages, built-in appliances, fireplaces, picture and bay windows and stairways may be included. Floors may be wood, tile, or fully carpeted. The exterior might be of any type including, e.g., stone, brick, brick veneer, wood frame and adobe brick. The house may have more than one story. In-wall pipes, plumbing fixtures, electrical wiring, and light fixtures may be included.

As shown in FIG. 3, house superstructure 15 has utility connections such as water pipe 62 and electrical power duct 61 for ultimate connection of water supply and electricity (with meter), respectively. In similar fashion, superstructure 15 may be provided with natural gas connection.

Construction of the house superstructure may be accomplished as steps in an assembly line by moving upper portion 11 along the floor of the plant while mounted in frame 100. Except for final external connection of utilities and sewer, every phase of construction of house 15 is completed prior to removal of house superstructure 15 and upper portion 11 from the interior of the plant.

When such construction is completed, an internally-threaded skirt anchor 44, as seen in FIG. 10, is inserted into each skirt attachment hole 42 until annular collar 46 of skirt anchor 44 rests against perimeter edge 40. Flexible air-cusion skirt 111, having a plurality of apertures 113 and shown in FIGS. 3 and 10 is attached to perimeter edge 40 by aligning each aperture 113 over a corresponding skirt attachment hole 42 and threading a bolt 73 through each aperture 113 and into a skirt anchor 44. While upper portion 11 rests on frame 100, skirt 111 drapes to floor surface of the plant.

As seen in FIG. 3, one end of hose 119 is inserted through air hole 121 in skirt 111 and the other end is connected to air blower 123 which is mounted on pulling tractor 129. Utility passageways 39 are effectively sealed with releasable seal means 126 such as a piece of cloth forced within each passageway 39. Air is then blown through hose 119 and air hole 121 thus creating an air-cushion within skirt 111. The air pressure within the skirt under the upper portion of the slab must be sufficient to support such upper portion and the house superstructure thereon. For example, if the area of the slab is 1000 sq. ft. and the slab and superstructure together weigh around 44 tons, a pressure of a little over 2 psi above atmosphere would be required. As soon as this skirt starts to leave the ground, leakage occurs to balance the air pressure and keep the slab and house structures from shooting up in the air. The blower capacity must be sufficient to produce the desired air pressure despite any leakage occurring within its upper part of the skirt and the upper portion of the slab. By virtue of this air-cushion, upper portion 11 is lifted from base 103 of mold 101 and, by means of pulling tractor 129 and guide tractor 125, moved away from mold 101 and frame 100. Both mold 101 and frame 100 are then returned to the beginning of the assembly line to be used in construction of another house. The house superstructure, supported by upper portion 11, and as shown in FIG. 3, is an intermediate step in constructing a home.

Transport of upper portion 11 with house superstructure 15 is along completed subdivision streets or along a partially cleared path which may include fairly rough terrain and may have both inclines and declines. All obstructions exceeding the height of the air cushion are removed from the path.

Figure 4:
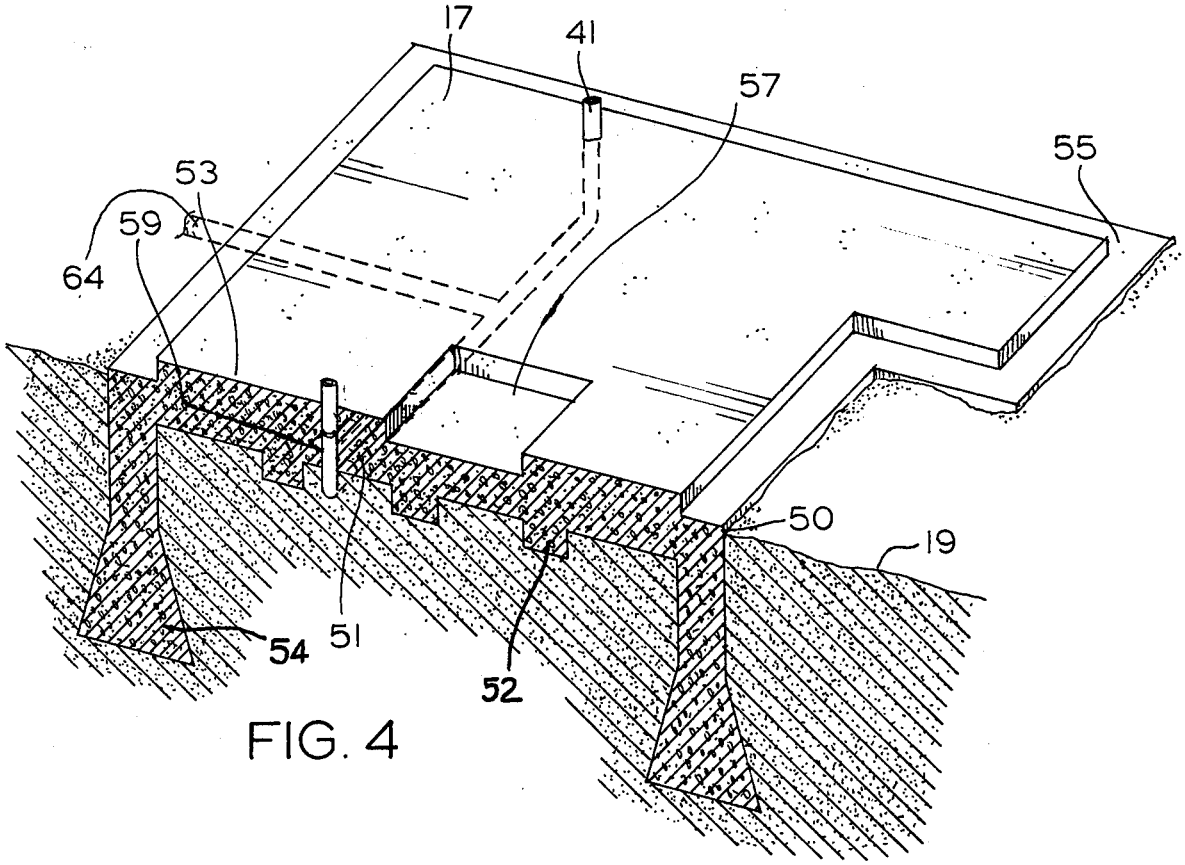
FIG. 4 is a section taken of a pictorial view of the lower portion of the foundation of said preferred embodiment.

The lot to which house superstructure 15 is transported is prepared prior to transport by clearing the portion of the lot on which the house is to sit and constructing a mating site. Construction of the preferred mating site shown as lower portion 17 in FIG. 4 is according to methods generally known in the art for construction of a reinforced concrete slab foundation having pier and beam construction, although a floating slab or other suitable form of slab construction can be used. The plan configuration of the slab portion 51 of lower portion 17 should correspond to the plan configuration of upper portion 11 to be mated to the mating site. Construction of lower portion 17 includes erection of the concrete form on the lot and arranging steel reinforcing rods and drainage pipes 59 therein. Drainage pipes 59 run horizontally beneath slab portion 51 from sewage connection 64, between piers 54, below beams 52, and through slab portion 51 forming vertical pipe ends 41 above slab portion 51. Pipe ends 41 are to be connected to plumbing fixtures within the house superstructure to be mated to the mating site, and, therefore, are positioned to correspond to pipe passageways 39 of upper portion 11. Location of sewage connection 64 is dependent upon the location of sewers in relation to lot 19.

The concrete form includes offsets whereby the upper surface 53 of slab portion 51 can be contoured with recesses 55 and 57 corresponding to ridges 29 and 31 of upper portion 11 to be mated with upper surface 53 of lower portion 17. Furthermore, the side walls of the concrete form are shaped to form lower-edge recess 56 about perimeter edge 50 of slab portion 51. (See FIG. 5).

After lower portion 17 has been constructed and allowed to cure, a thin layer of epoxy resin bonding material 66 (See FIG. 5) is spread evenly over upper surface 53 of lower portion 17. As shown in FIG. 6, air cushion supported house superstructure 15 and upper portion 11 are then aligned above lower portion 17 such that pipe passageways 39 are positioned directly above pipe ends 41 and perimeter edges 40 and 50 properly correspond to one another. With the upper and lower portions thus in register, they are telescoped together. To accomplish this the air cusion is gradually released and upper portion is lowered while pipe ends 41 move into pipe passageways 39 thus forcing seal means 126 from pipe passageways 39.

When upper portion 11 is fully lowered onto lower portion 17 such that lower surface 27 meshes with upper surface 53 of lower portion 17, skirt 111 is removed from perimeter edge 40 by removing bolts 73 from skirt anchors 44.

Figure 5:
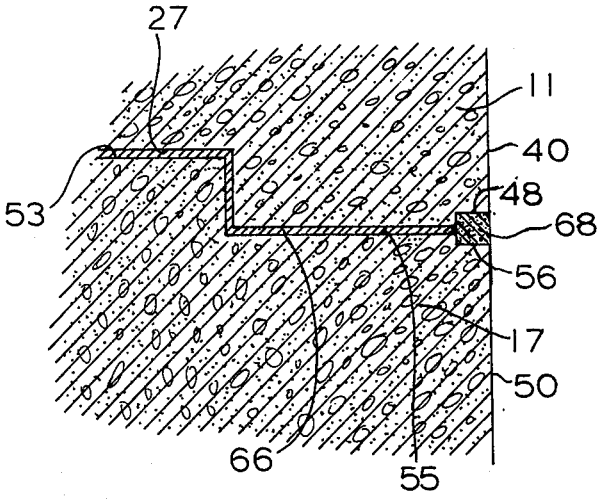
FIG. 5 is a detailed section of the mated upper and lower portions of the foundation showing the edge recesses.
Figure 6:
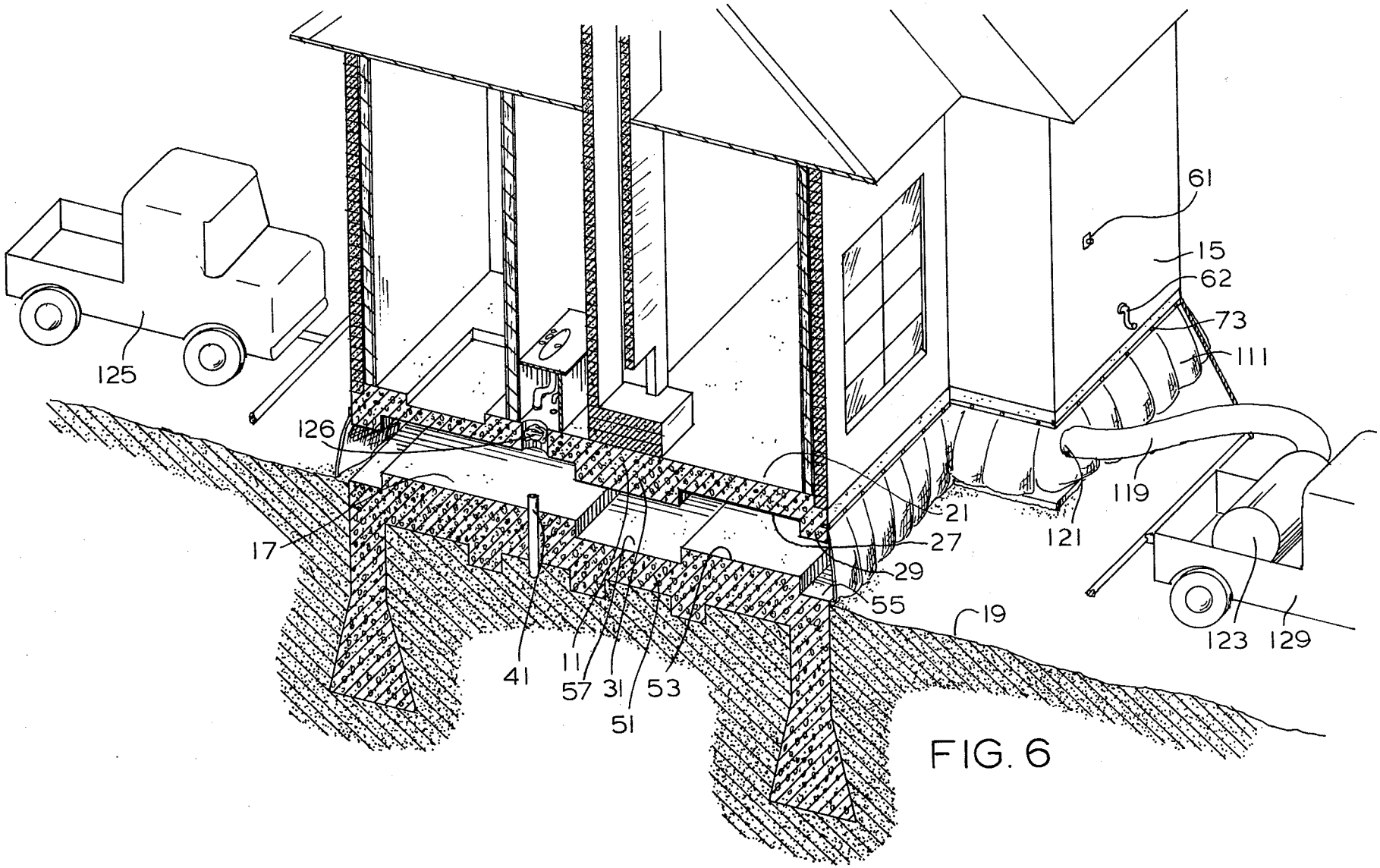
FIG. 6 is a section taken of a pictorial view of said preferred embodiment immediately prior to mating of upper portion with lower portion.

As shown in FIG. 5, after mating of upper portion 11 with lower portion 17, mortar 68 is inserted into the groove formed by upper edge and lower edge recesses 48 and 56. Mortar 68 can be smoothed by running a trowel about the periphery of the completed foundation thus effectively hiding the line showing the junction between the upper portion and the lower portion. When mortar 68 and bonding material 66 dries, the upper portion is chemically bonded to the lower portion.

Figure 7:
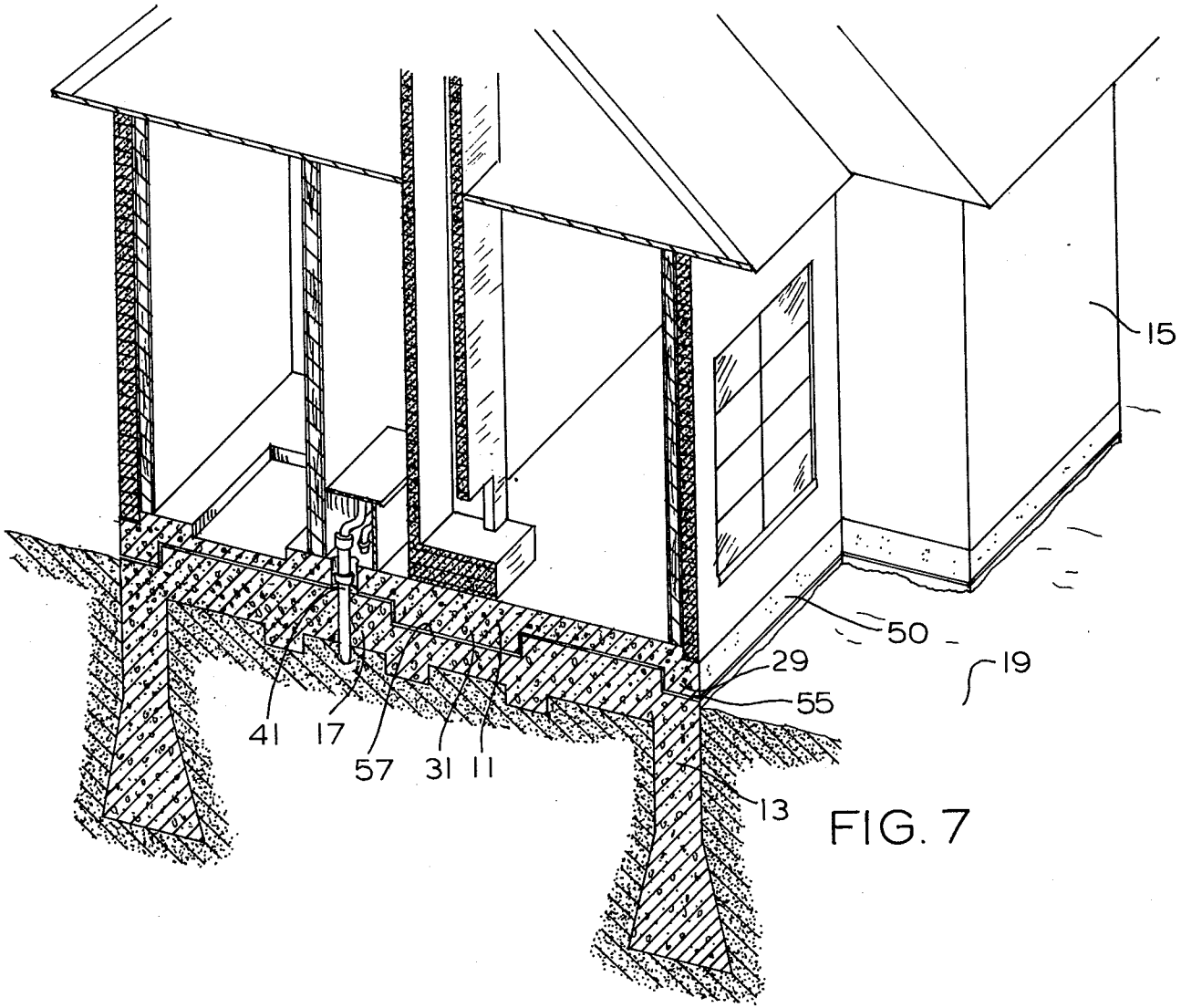
FIG. 7 is a section taken of a pictorial view of said preferred embodiment upon completion.

At this time, pipe ends 41 are appropriately connected to plumbing fixtures. The house is then ready for occupancy. The completed house, as shown in FIG. 7, is an example of preferred embodiment of the article of manufacture resulting from the inventive method.

Numerous alternative techniques for performing the steps of the method of the invention exist.

For instance, the house may be fully constructed upon the upper portion of the foundation before moving the upper portion within the factory. Entire assembly, however, would remain indoors.

Also, the upper portion of the foundation can be allowed to cure prior to being placed on a mobile frame. Upon curing, the upper portion is then removed from the mold by crane and placed on a mobile frame. This is possible due to the lighter weight of the upper portion prior to construction of a house superstructure thereon.

Figure 11:
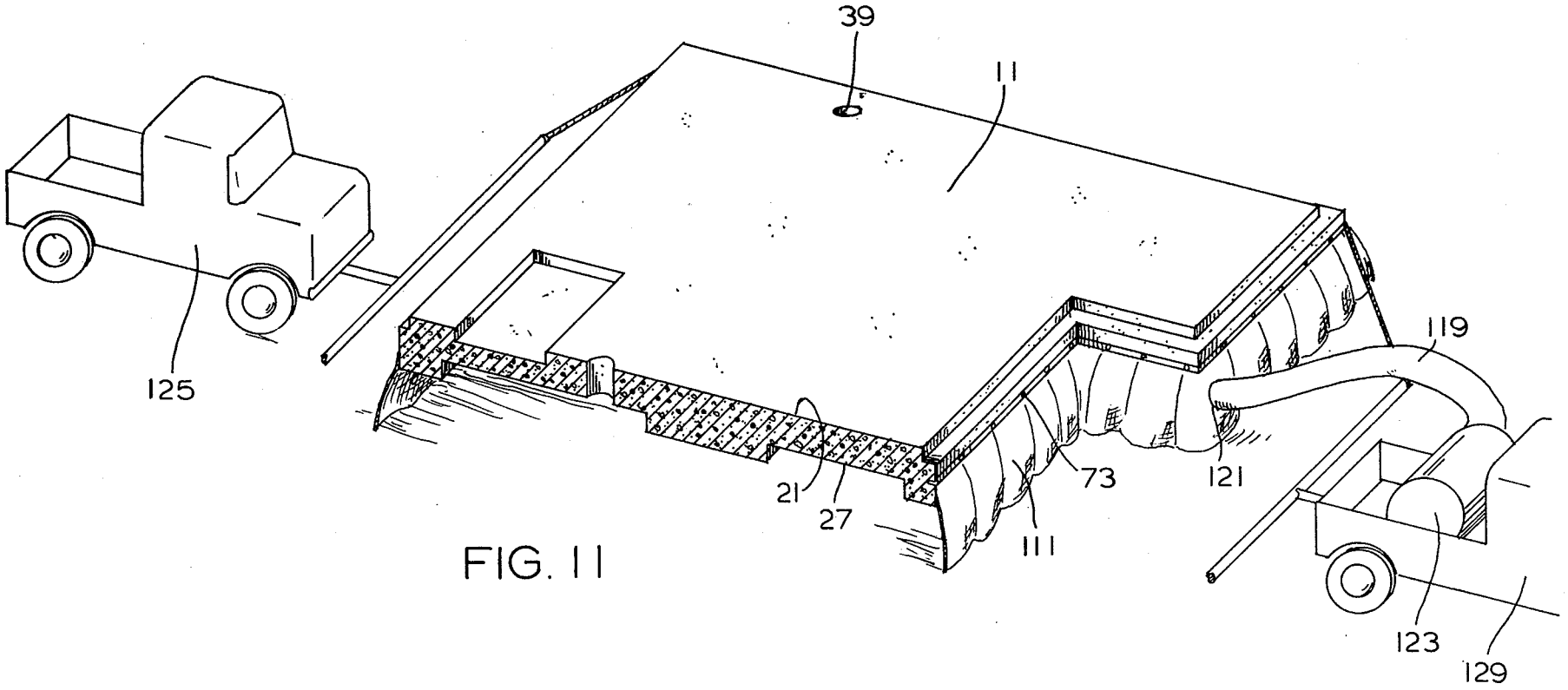
FIG. 11 is a section taken of a pictorial view of an alternative method of transporting the upper portion of the foundation through the assembly line.

FIG. 11 shows an alternative method of transporting the upper portion 11 of the foundation. Skirt 111 is attached immediately after upper portion 11 is cured. Thus, upper portion 11 is moved from one stage in construction of the house super-structure to another stage by means of air cushion transport. When house superstructure is completed, the unit including upper portion 11 and house superstructure 15 may be moved immediately to the mating site.

Furthermore, utility connections may be made in a fashion similar to that of the drainage pipes 59 and sewer connection 64 by running utility ducts beneath and through slab portion 51 of lower portion 17.

Figure 12:
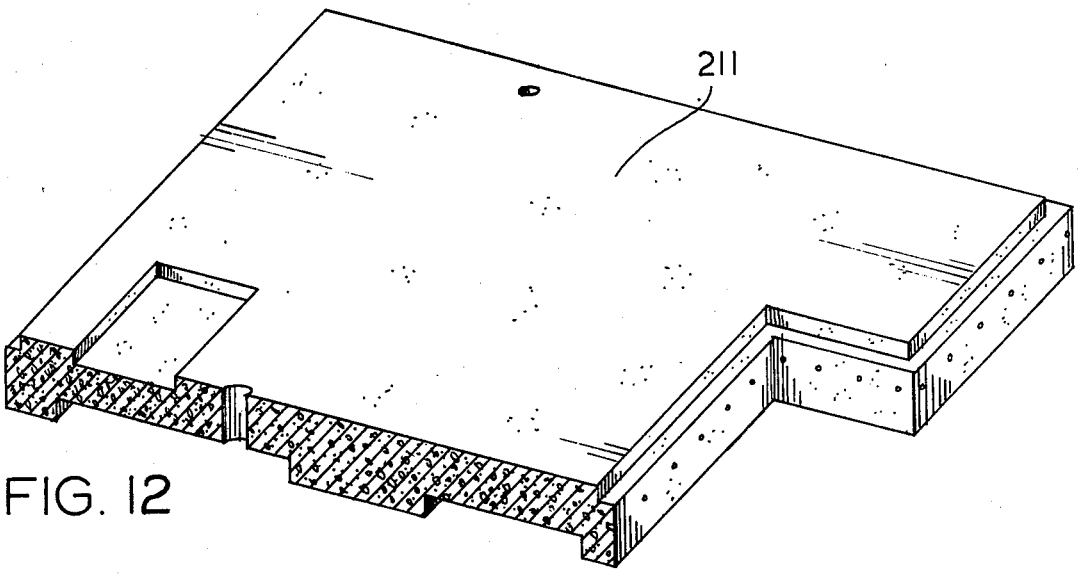
FIG. 12 is a section taken of a pictorial view of the upper portion of the foundation of an alternative embodiment of the invention.
Figure 13:
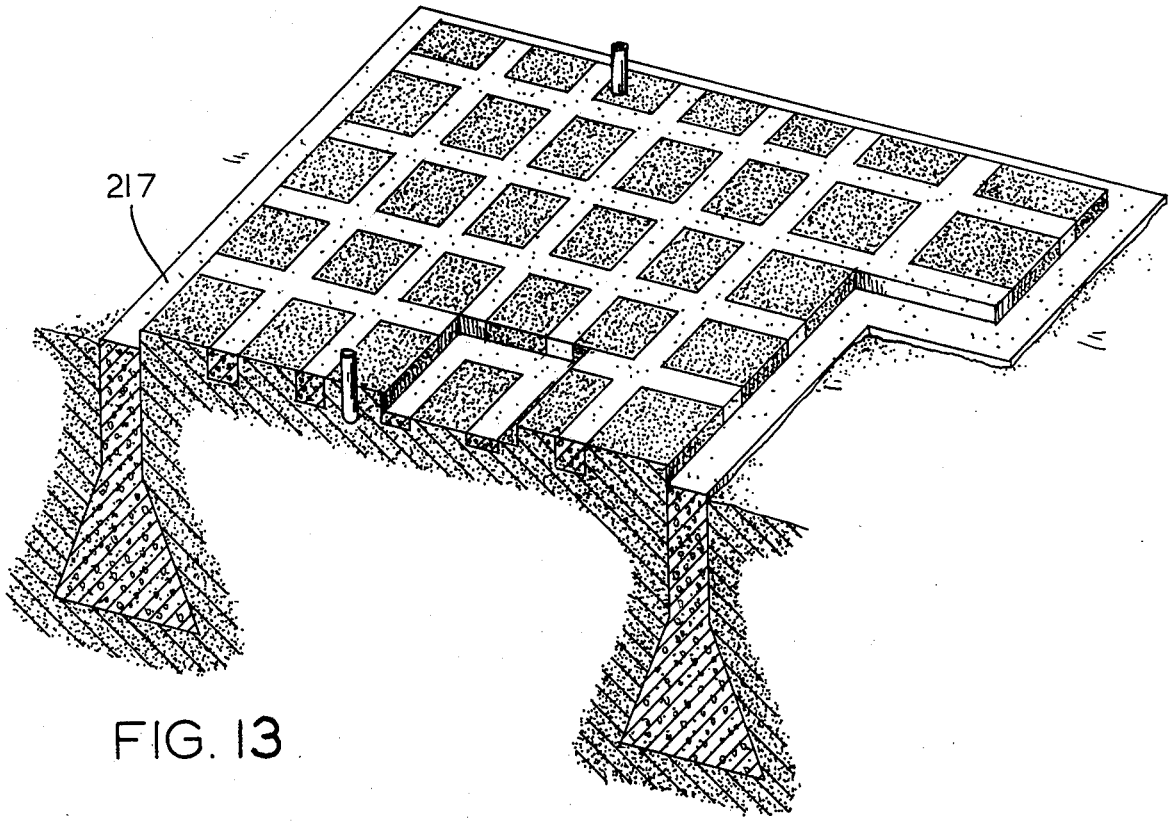
FIG. 13 is a section taken of a pictorial view of the lower portion of the foundation of an alternative embodiment of the invention.

Construction of upper portion and lower portion can result in the alternative embodiments of FIGS. 12 and 13. In this embodiment, lower portion 217 has no slab portion. Lower portion 217 may be formed by clearing the lot to the bedrock, pouring piers in the bedrock, erecting beams upon the piers and the bedrock such that the outer beams form a periphery having a configuration adapted to receive the upper portion, and filling in the spaces within the periphery with sand such that a level surface is formed by the beams and sand. Because lower portion 217 has no slab portion, upper portion 211 normally is thicker in this alternative embodiment than it is in the preferred embodiment.

Figure 14:
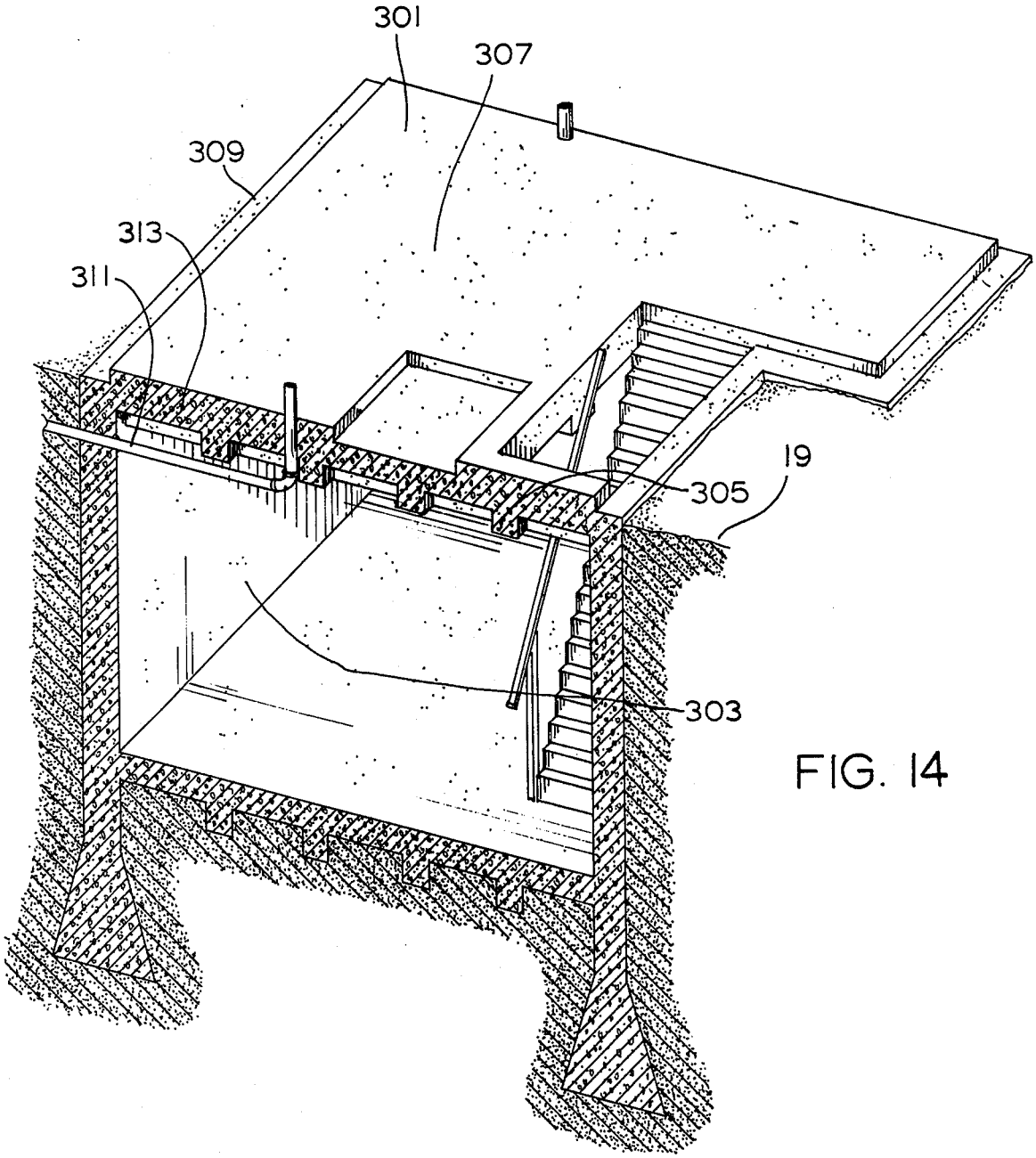
FIG. 14 is a sectional view of an alternative embodiment of the lower portion.

Also, construction of the lower portion of the foundation can result in the alternative embodiment of FIG. 14 wherein a basement is included. Construction of basement slab 301 and basement walls 303 is by techniques generally known in the art. Steel reinforced beams 305 support upper mating surface 307 of lower portion 309. Utility ducts, shown as pipes 311, run beneath beams 305 and extend through slab portion 313. The entire basement of lower portion 309 is substantially completed prior to mating of upper portion.

Figure 15:
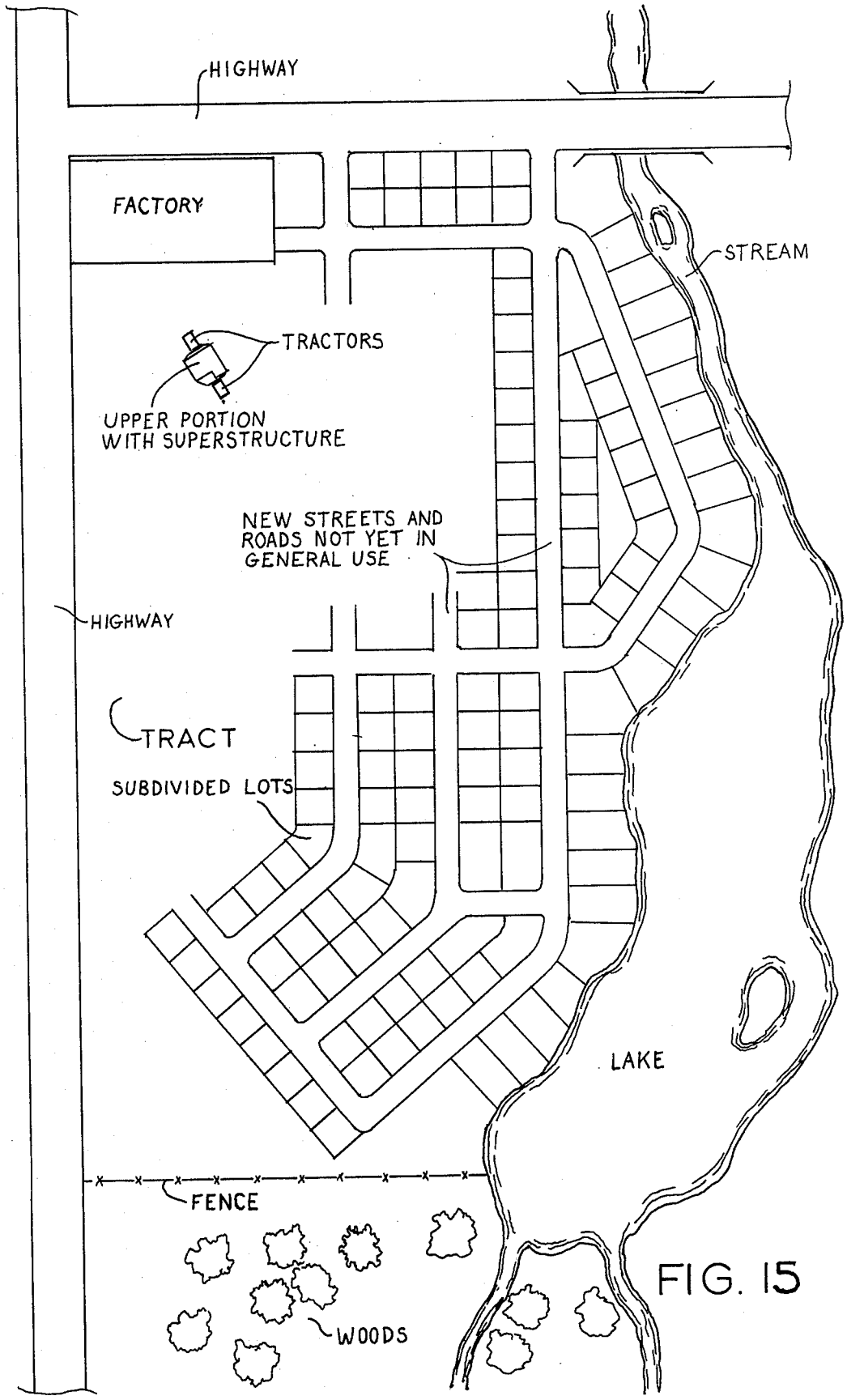
FIG. 15 is a plan view illustrating the method of the invention.

The foregoing description relates primarily to the house structure. The factory is also an important element of the method. As shown in FIG. 15, the factory is preferably located adjacent a highway or railroad spur to make it readily accessible to the workman and to make it easy to bring in supplies of building materials. The factory should be big enough to allow several house structures to be worked on at once as in an assembly line, and to provide space for storage of materials and facilities such as overhead cranes for handling same. Portable scaffolding, elevated work bays and machine tools will be provided. The factory is built on a tract that can be subdivided into a large number of lots, for example, a thousand, to receive house structures built in the factory and transported off-highway (no traffic problem or weight and width limitations) by air cushion transport to the desired lots.

While it has been emphasized that the factory should be enclosed in order to provide a controlled environment, the degree of enclosure may of course vary. For example there may be certain parts which are totally enclosed and others which are merely roofed to protect against the sun or screened to protect against insects or animals, or provided with a wall to protect from the wind, or merely elevated to protect against high water, or paved to protect against ground water, dust, and mud. In any event some form of preparation will have been made to constitute a factory suitable for the particular requirements of the area where the factory is located and the work to be performed.

The method of the invention and the resulting articles of manufacture have been described in detail sufficient to enable one of ordinary skill in the art to make and perform the same. Modifications and alterations of the preferred embodiments and the preferred methods in addition to those described herein and which do not depart from the spirit of the invention will occur to others upon a reading and understanding of the specification and it is our intention to include all such modifications and alterations as part of our invention insofar as they come within the scope of the claims.

We claim:

1. A method of erecting a house comprising the steps of constructing a transportable concrete first slab having a lower surface at a factory site, constructing a superstructure upon said first slab, preparing a mating site for said first slab on a lot remote from said factory site, said mating site having an upper surface, transporting said first slab and superstructure to said mating site, and mating said lower surface of said first slab with said upper surface of said mating site such that there are no substantial air gaps between said lower surface of said first slab and said upper surface of said mating site and such that said first slab becomes substantially integrated with said mating site.

2. A method of erecting a house according to claim 1 wherein the steps of constructing a first slab and constructing a superstructure thereon are carried out at said factory site within an enclosed structure.

3. A method of erecting a house according to claim 1 wherein the steps of transporting said first slab and superstructure is accomplished by air-cushion transport using a flexible skirt attached to the periphery of said first slab.

4. A method of erecting a house wherein air-cushion transport of said first slab and superstructure comprising the steps of constructing a transportable concrete first slab at a factory site, constructing a superstructure upon said first slab, preparing a mating site for said slab on a lot remote from said factory site, transporting said first slab and superstructure to said mating site by releasably attaching an air-impermeable, flexible skirt to the periphery of said first slab in a substantially air tight manner, injecting air within the confines of said skirt whereby air is forced beneath said first slab causing it to rise on an air-cushion, and towing the air-cushion supporting first slab and superstructure, and mating said first slab with said mating site.

5. A method of erecting a house according to claim 4 wherein the steps of attaching an air-impermeable, flexible skirt to the periphery of the first slab includes the steps of forming a plurality of bolt holes about the periphery of said first slab, inserting a threaded bolt anchor into each said bolt hole, bolting said skirt to said first slab by inserting a bolt through each of a plurality of apertures in the upper edge of said skirt and threading the bolt into one of said bolt anchors.

6. A method of erecting a house according to claim 5 wherein the step of mating said first slab to said mating site includes removing said air-impermeable skirt by unthreading each said bolt from said bolt anchor.

7. A method of erecting a house according to claim 6 wherein the step of preparing a mating site includes constructing a fixed concrete slab on said remote lot, and wherein the step of mating said first slab to said mating site further includes resting said first slab on said second slab.

8. A method of erecting a house according to claim 6 wherein the step of preparing a mating site includes constructing a fixed concrete second slab on said remote lot, and wherein the step of mating said first slab to said mating site further includes spreading a chemical bonding agent upon the upper surface of the mating site and then resting said first slab on said second slab.

9. A method of erecting a house according to claim 4 wherein the steps of constructing a first slab and constructing a super structure thereon are carried out at said factory site entirely within an enclosed structure.

10. A method of erecting a house according to claim 9 wherein the steps of constructing a first slab and constructing a superstructure thereon are carried out in assembly-line fashion by physically moving the uncompleted first slab and superstructure through a sequence of construction phases.

11. A method of erecting a house according to claim 1 wherein the step of constructing a first slab includes erecting a mold for said first slab on a movable frame.

12. A method of erecting a house according to claim 1 wherein the step of preparing the mating site includes erecting substructure utility connections, the step of constructing a first slab includes providing said slab with duct access means for accommodating said substructure utility connections, and the step of mating said lower surface of said first slab with the upper surface of said mating site includes inserting said substructure utility connections through said duct access means by lowering said first slab onto said mating site.

13. A method of erecting a house comprising the steps of constructing a transportable concrete first slab at a factory site, including erecting a first slab mold, pouring concrete into said mold, removing sides of said mold, disposing a skirt attachment means about the periphery of said first slab formed in said mold, and attaching a flexible, air-impermeable skirt to said first slab using said skirt attachment means, constructing a superstructure upon said first slab, preparing a mating site for said slab on a lot remote from said factory site, transporting said first slab and superstructure to said mating site, and mating said first slab with said mating site.

14. A method of erecting a house according to claim 1 wherein the step of preparing a mating site includes clearing a portion of the remote lot to the bedrock, forming concrete piers in the bedrock, erecting concrete beams above the bedrock such that the upper surface of the beams are level, filling the space between the beams with sand such that a flat surface is formed within the periphery of the beams by the beams and sand, said beams and flat surface forming the upper surface of said mating site.

15. A method of erecting a house according to claim 14 wherein the step of mating said first slab with said mating site includes resting said first slab on the flat surface formed by the beams and sand and securing the first slab to the outer beams of the mating site.

16. A method of erecting a house comprising the steps of constructing a transportable concrete first slab at a factory site by erecting a first slab mold, placing passageway mold cylinders in said slab mold, and pouring concrete into said mold whereby passageways are formed in said first slab, constructing a superstructure upon said first slab, preparing a mating site for said slab on a lot remote from said factory site, including clearing a portion of said remote lot and constructing a concrete slab form thereon, running utility ducts beneath said form such that ducts to be attached to fixtures within the house extend vertically upwardly and above the top of said form, and pouring concrete into said slab form so as to make a second slab, transporting said first slab and superstructure including temporarily sealing said passageways, attaching an air-impermeable flexible skirt to the periphery of said first slab, injecting air within the confines of said skirt whereby air is forced beneath said first slab causing it to rise on an air-cushion, and towing the first slab and superstructure to said remote lot, and mating said first slab with said second slab including aligning said passageways in said first slab directly above said vertically extending utility ducts in said second slab while air-cushion is still in effect and gradually releasing said air-cushion until said first slab rests on said second slab.

17. A method of erecting a house comprising, clearing and levelling an area of land, erecting a concrete foundation including slab support means on said area of land, and pouring a concrete slab at a fabrication site remote to said area of land, erecting a wooden-frame house on said slab, and releasably attaching an air-impermeable flexible skirt to the perimeter of said slab, blowing air into the area bounded by said skirt until an air cushion sufficient to lift said slab off the ground is established, towing the air-cushion supported slab and house by tractor means to said area of land and while continuously introducing additional compressed air beneath said slab to substitute for any compressed air that may escape during transport, positioning said air-cushion supported slab and building over said slab support means, releasing said compressed air from beneath the slab so that said slab is lowered onto said slab support means, and removing said skirt.

18. A method of erecting a house according to claim 17 where said fabrication site is indoors.

19. A method of erecting houses comprising the steps of subdividing an area of land into a plurality of lots, clearing and levelling a portion of each of said lots and erecting concrete foundations including slab support means on each said portion, erecting house superstructures with concrete slab foundations in an indoor fabrication site substantially central to said area of land, transporting completed said house superstructures off-highway from said fabrication site to said lots, placing said slab foundation of said houses on said slab support means.

20. A method of erecting houses comprising the steps of clearing and levelling a plurality of mating sites, erecting a concrete foundation including slab support means on each mating site, pouring a first concrete slab at a first location in an indoor fabrication site remote to said mating sites,
allowing said first concrete slab to cure,
transporting said first concrete slab to a second location in said indoor fabrication site,
pouring a second concrete slab at said first location,
erecting a first house on said first concrete slab,
transporting said first concrete slab and first house to a first mating site by air-cushion transport using a flexible skirt attached to said concrete slab,
mating said first concrete slab and first house with the slab support means corresponding to said first mating site,
allowing said second concrete slab to cure,
transporting said second concrete slab to said second location,
erecting a second house on said second concrete slab.

21. Method of erecting houses comprising the steps of
selecting a tract of unimproved land accessible to a highway and suitable to receive a large number of homes in the order of several hundred at least,
surveying the tract to divide it up into lots to receive the homes,
erecting a covered house structure factory on the tract adjacent the highway,
building house structures in the factory,
preparing house structure sites on the lots,
transporting the house structures off-highway from the factory to the lots by air-cushion transport using flexible skirts attached to the house structures, and
mating the house structures with the sites.

22. A transportable concrete slab comprising
a generally flat upper surface,
a generally flat lower surface,
a flexible skirt disposed about the outer periphery of the slab,
means releasably attaching said skirt to said slab in a substantially air tight manner,
said skirt and said slab being impermeable to air.

23. A transportable concrete slab according to claim 22 wherein said lower surface includes a ridge extending about the periphery of said lower surface for reinforcing the periphery of said slab.

24. A transportable concrete slab according to claim 22 wherein said means releasably attaching said skirt includes a plurality of internally-threaded anchors disposed in the periphery of said slab with a plurality of bolts inserted through said skirt and threadingly received by one of said anchors.

25. A transportable concrete slab comprising
a generally flat upper surface,
a generally flat lower surface,
a plurality of utility duct passageways therethrough,
said passageways being made air impermeable by releasable seal means disposed within said passageways,
a flexible skirt disposed about the outer periphery of the slab,
means releaseably attaching said skirt to said slab in a substantially air tight manner,
said skirt and said slab being impermeable to air.

26. A transportable house comprising an air-impermeable concrete slab adapted to be received in a mating site, a
house superstructure constructed thereon,
a flexible, air-impermeable skirt disposed about the outer periphery of said slab, and
means releasably attaching the upper part of said skirt to said slab to hold said upper part to said slab against the force of air pressure inside said skirt when pressurized air is introduced therewithin and thereby to prevent unrestricted flow of such pressurized air through any leakage path between said upper part of the skirt and said slab.

27. A transportable house according to claim 26 wherein said slab has a lower surface with ridges thereon whereby the slab has areas of increased thickness reinforcing against the weight of items within said superstructure.

28. A transportable house according to claim 26 wherein said means releasably attaching said skirt includes a plurality of internally-threaded anchors disposed in the periphery of said slab with a plurality of bolts each inserted through said skirt and threadingly received by one of said anchors.

29. A transportable house comprising
an air-permeable concrete slab adapted to be received in a mating site, said slab having a lower surface with a ridge about the periphery of said lower surface providing the slab an area of increased thickness reinforcing against the weight of the exterior wall, said ridge extending a distance from the periphery of said slab that is greater than the thickness of said wall,
a house superstructure constructed on said slab,
a flexible, air-impermeable skirt disposed about the outer periphery of said slab, and
means releaseably attaching the upper part of said skirt to said slab to hold said upper part to said slab against the force of air pressure inside said skirt when pressurized air is introduced therewithin and thereby to prevent unrestricted flow of such pressurized air through any leakage path between said upper part of the skirt and said slab.

30. A transportable house comprising
an air-impermeable concrete slab adapted to be received in a mating site,
a house superstructure constructed on said slab,
a flexible, air-impermeable skirt disposed about the outer periphery of said slab, and
means releasably attaching the upper part of said skirt to said slab to hold said upper part to said slab against the force of air pressure inside said skirt when pressurized air is introduced therewithin and thereby to prevent unrestricted flow of such pressurized air through any leakage path between said upper part of the skirt and said slab,
said superstructure having a fireplace, said fireplace resting on said slab,
said slab having increased thickness at the point where said fireplace rests, said area of increased thickness being greater than the area of contact between said fireplace and said slab.

31. A transportable house comprising
an air-impermeable concrete slab adapted to be received in a mating site, said slab having a plurality of utility duct passageways extending therethrough,
said passageways being made air impermeable by releaseable seal means disposed within said passageways,
a house superstructure constructed on said slab,
a flexible, air-impermeable skirt disposed about the outer periphery of said slab, and means releaseably attaching the upper part of said skirt to said slab to hold said upper part to said slab against the force of air pressure inside said skirt when pressurized air is introduced therewithin and thereby to prevent unrestricted flow of such pressurized air through any leakage path between said upper part of the skirt and said slab.

32. A house comprising a concrete slab foundation including an upper portion having a generally flat lower surface and a lower portion having a generally flat upper surface, said lower surface of said upper portion meshing with said upper surface of said lower portion such that said upper portion and said lower portion form a substantially integrated unit, said upper portion being rigidly secured to said lower portion, and a house superstucture on the upper surface of said upper portion, said lower surface of said upper portion having a plurality of downwardly extending ridges and said upper surface of said lower portion having a plurality of recesses in which said ridges are received.

33. A method of erecting a house comprising the steps of constructing a transportable concrete slab at a factory site, constructing a superstructure upon said slab, preparing a mating site for said slab on a lot remote from said factory site, lifting said slab by exerting a force that produces negligible bending moment upon said first slab, transporting said slab and building to said mating site, and mating said first slab with said mating site, such that said first slab and said mating site become an integral unit.

34. A method of developing remote areas of land comprising:

subdividing a first area of land into a plurality of lots, clearing and levelling a portion of each of said lots, erecting concrete foundations on the cleared and levelled portions of said lots, assembling an enclosed factory upon said first area of land, erecting house superstructures with concrete slab foundations in said factory, transporting completed said house superstructures from said factory to said lots, disassembling said factory, transporting the disassembled said factory to a second area of land, and assembling said factory upon said second area of land.

* * * * *